US009004592B2

(12) United States Patent
Boston

(10) Patent No.: US 9,004,592 B2
(45) Date of Patent: Apr. 14, 2015

(54) WHEELCHAIR SLIPCOVER

(71) Applicant: Kristin Scheifele, Pacific Palisades, CA (US)

(72) Inventor: Barbara Boston, Altadena, CA (US)

( * ) Notice: Subject to any disclaimer, the term of this patent is extended or adjusted under 35 U.S.C. 154(b) by 102 days.

(21) Appl. No.: 13/688,199

(22) Filed: Nov. 28, 2012

(65) Prior Publication Data

US 2014/0145478 A1 May 29, 2014

(51) Int. Cl.
*A47C 31/11* (2006.01)
*A61G 5/02* (2006.01)

(52) U.S. Cl.
CPC ..... *A61G 5/02* (2013.01)

(58) Field of Classification Search
CPC ..... A47C 31/11; A61G 5/10; A61G 5/1043
USPC ..... 297/225, 228.1, 229
See application file for complete search history.

(56) References Cited

U.S. PATENT DOCUMENTS

| | | | | |
|---|---|---|---|---|
| 1,789,245 | A * | 1/1931 | McIntyre | 297/110 |
| 3,695,690 | A * | 10/1972 | Carson | 297/218.3 |
| 4,455,008 | A | 6/1984 | MacKew | |
| 5,121,938 | A | 6/1992 | Gross et al. | |
| 5,154,331 | A | 10/1992 | Sanders | |
| 5,893,607 | A | 4/1999 | Trimnell | |
| 6,481,736 | B1 * | 11/2002 | Chan | 280/288.4 |
| 6,857,649 | B2 | 2/2005 | Patton | |
| 6,866,337 | B1 | 3/2005 | Lash | |
| 7,040,642 | B2 | 5/2006 | Lowry | |
| 7,156,458 | B2 * | 1/2007 | Hanberg | 297/219.12 |
| 7,278,649 | B2 * | 10/2007 | Daniels | 280/304.1 |
| 7,334,712 | B2 | 2/2008 | Hassett et al. | |
| D626,462 | S | 11/2010 | Stopyra | |
| 8,678,418 | B1 * | 3/2014 | Quarles | 280/304.1 |
| 2004/0041449 | A1 | 3/2004 | Bluhm | |
| 2007/0069560 | A1 | 3/2007 | Ranney | |
| 2008/0001451 | A1 * | 1/2008 | Olson | 297/219.12 |
| 2010/0045209 | A1 * | 2/2010 | Daley et al. | 315/294 |

FOREIGN PATENT DOCUMENTS

| | | |
|---|---|---|
| JP | 11313735 | 11/1999 |
| JP | 2006102436 | 4/2006 |
| WO | WO-2009144629 | 3/2009 |

* cited by examiner

*Primary Examiner* — Sarah B McPartlin
(74) *Attorney, Agent, or Firm* — Tsircou Law, P.C.

(57) ABSTRACT

A wheelchair slipcover is provided that includes a first covering member and a second covering member that is adjustable for different wheelchair sizes and configurations. The first covering member has a back covering portion covering a back of the wheelchair, armrest covering portions extending around from both sides of the back covering portion and attaching vertically along the seat portion of the wheelchair. A second covering member covers the seat and the backrest, positioned on the first covering member.

14 Claims, 9 Drawing Sheets

WHEELCHAIR SLIPCOVER

FIELD OF THE INVENTION

The present invention relates generally to a wheelchair slipcover and, more particularly, a slipcover that is adjustable to fit different wheelchair sizes and configurations.

BACKGROUND OF THE INVENTION

Wheelchairs are used by people who have difficulty walking due to an illness or injury and are generally manufactured in a practical and cost-efficient way. The standard wheelchair is generally made with seating material that is either black or navy with an exposed dark metal frame, with limited padding and support. However, wheelchairs come in different sizes and configurations to accommodate various uses and people of different weight and height.

There are wheelchair slipcovers in the prior art that address some of the shortfalls of a standard wheelchair. However, none of these slipcovers adjusts to fit on different wheelchair sizes. For example, a facility with many wheelchairs, such as a hospital or nursing home, seeking to use slipcovers to maintain sanitary conditions would have to obtain specific slipcovers for each different wheelchair size.

There are many people who use wheelchairs that utilize several specialized wheelchairs adapted for particular needs, such as work, sports, or other outdoor activities. Others may have a standard, manually powered wheelchair and a motorized wheelchair. Nonetheless, wheelchair slipcovers in the prior art do not address the need for an adjustable wheelchair slipcover that can fit on different wheelchair types and sizes for users who may use multiple types of wheelchairs throughout a day.

Thus, there is a need for a wheelchair slipcover that is adjustable to fit many different sizes and configurations of a wheelchair.

SUMMARY OF THE INVENTION

Briefly, and in general terms, the invention provides an adjustable wheelchair slipcover that covers the entire chair area for comfort, safety, aesthetic, and hygienic purposes. The slipcover is adjustable to fit a variety of wheelchairs that differ in size and configuration.

In addition, the present invention is customizable and provides users the ability to modify the color and design of a wheelchair slipcover. Although there is a common misconception that a person in a wheelchair is sick or helpless, many wheelchair users lead active and satisfying lives. As such, there is a desire for users to express their individuality with personalized slipcovers.

The wheelchair slipcover comprises a first covering member and a second covering member. The first covering member has a back covering portion covering a back of the wheelchair, armrest covering portions extending around from both sides of the back covering portion and attaching vertically along the seat portion of the wheelchair. More specifically, the back covering portion covers around the back surface of the wheelchair and securely wraps around the rear posts on the back of the wheelchair.

The first covering member can include a left front portion and a right front portion configured to be disposed over a portion of a front surface of the back of the wheelchair. Each front portion having a terminal edge in adjacent relationship to each other. Attachments couple the left and the right front panels, across the front side of the back of the wheelchair.

A second covering member covers the seat and backrest, atop of the first covering member. The second covering member disposed on the top of the backrest and extends to the front edge of the seat. In a detailed aspect of an exemplary embodiment, the second covering member is padded to provide comfort and support for the backrest and seat. In another detailed aspect of an exemplary embodiment, the second covering member is comprised of a flexible, waterproof fabric that can be wiped down clean with a mild cleaner.

In a detailed aspect of an exemplary embodiment, the slipcover can adjust for various widths of different wheelchair sizes. , the wheelchair slipcover includes a plurality of vertical fasteners, such as hook-and-loop fasteners, along the lateral edges of the backrest and seat of the first covering member to attach the second covering member to the first covering member. The vertical fastener strips extend from the top of the back rest to the front edge of the seat and attach to corresponding vertical strips on back end of the second covering member. For larger or wider wheelchairs, the first covering member can laterally expand and attach to the second covering member by the outermost vertical fastener strips. In contrast, for smaller or narrower wheelchairs, the first covering member can laterally collapse and attach to the second covering member by the innermost vertical fastener strips.

The wheelchair slipcover can also comprise a third covering member covering a cushion placed on the seat of the wheelchair. The cushion can be removably attached to the inner armrest portion of the first covering member, the seat portion of the second covering member, or both. Alternatively, the cushion secured in placed by wedging between the armrests. A detachable cushion allows a user to fold up the wheelchair with the slipcover in place. Since a cushion is padded for cushion and support, an attached cushion on a wheelchair slipcover will generally be either foldable but thin and lacking substantial cushioning or support, or be thick and provide support but prevent a wheelchair to be folded up and stored. A detachable cushion allows a user to have both the support of a well-padded cushion and the ability to fold and store a wheelchair with the slipcover still on. Also, in a detailed aspect of an exemplary embodiment, the cushion comprises the same waterproof fabric as on the wheelchair slipcover, allowing quick and economical cleaning The second covering member allows a user to quickly and economically maintain the sanitation and cleanliness of the wheelchair. In facilities such as hospitals and nursing homes where wheelchairs are used extensively, multiple patients can safely use a wheelchair without constantly sanitizing the wheelchair or increasing the risk of transmitting a contagious disease by simply replacing the detachable covering member for every new patient that uses the wheelchair. Unlike single piece slipcovers, which have to be completely removed from the wheelchair to be washed, the present invention can utilize multiple covers and be in use for a longer period of time without having to purchase additional slipcovers.

More specifically, the slipcover is easy to clean, without having to remove the entire cover.

Moreover, the detachable covering member can provide a way to customize the appearance of the wheelchair with colorful, personalized slipcovers. Slipcover users will be offered a choice of colored fabric, logos, names, silk-screening, and the like. Even with a personalized slipcover, wheelchair users may be weary of the monotony of the same chair everyday. With the detachable covering member, a user can alternate different colors or styles at any time. For example, an avid sports fan can swap out professional sports team themed covering members for seasonal sports throughout the year.

Furthermore, hospitals and nursing homes can pursue commercial opportunities by placing advertisements on the covering member or on a detachable display on the back of the wheelchair. Since advertisements are generally time sensitive, advertisements placed on the detachable covering member or back display can be quickly changed or added.

In one aspect of an exemplary embodiment, a plurality of detachable pockets can be disposed on the inside of the armrest, outside of the armrest, in the back, or underneath the wheelchair seat. The external pockets are connected by a fastening means such as hook-and-loop fasteners, buttons, zippers, and the like. In certain instances, the detachable pockets may be an important safety feature for the user. Important items, such as a wallet or cell phone, can be stored in a detachable pocket on the inside of the armrest so that it can be easily reached. When the wheelchair is not in use, the user can simply remove the detachable pocket.

In yet another aspect of an exemplary embodiment, the wheelchair slipcover is equipped with a reflective nighttime piping that enhances visibility the wheelchair at night or low visibility. Since wheelchairs are generally manufactured with seating material that is black or navy with a dark metal frame, a wheelchair is nearly invisible at night. Reflective nighttime piping will visibly outline the wheelchair shape and make it immediately recognizable and identifiable.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
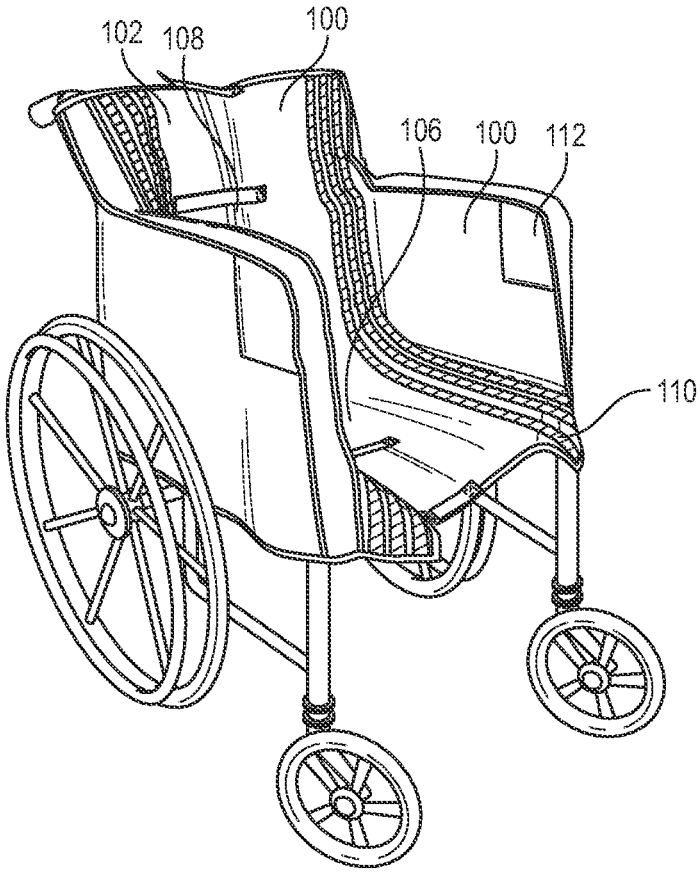
FIG. 1 is a perspective view of the first covering member of the wheelchair slipcover according to an exemplary embodiment of the present invention.
Figure 2:
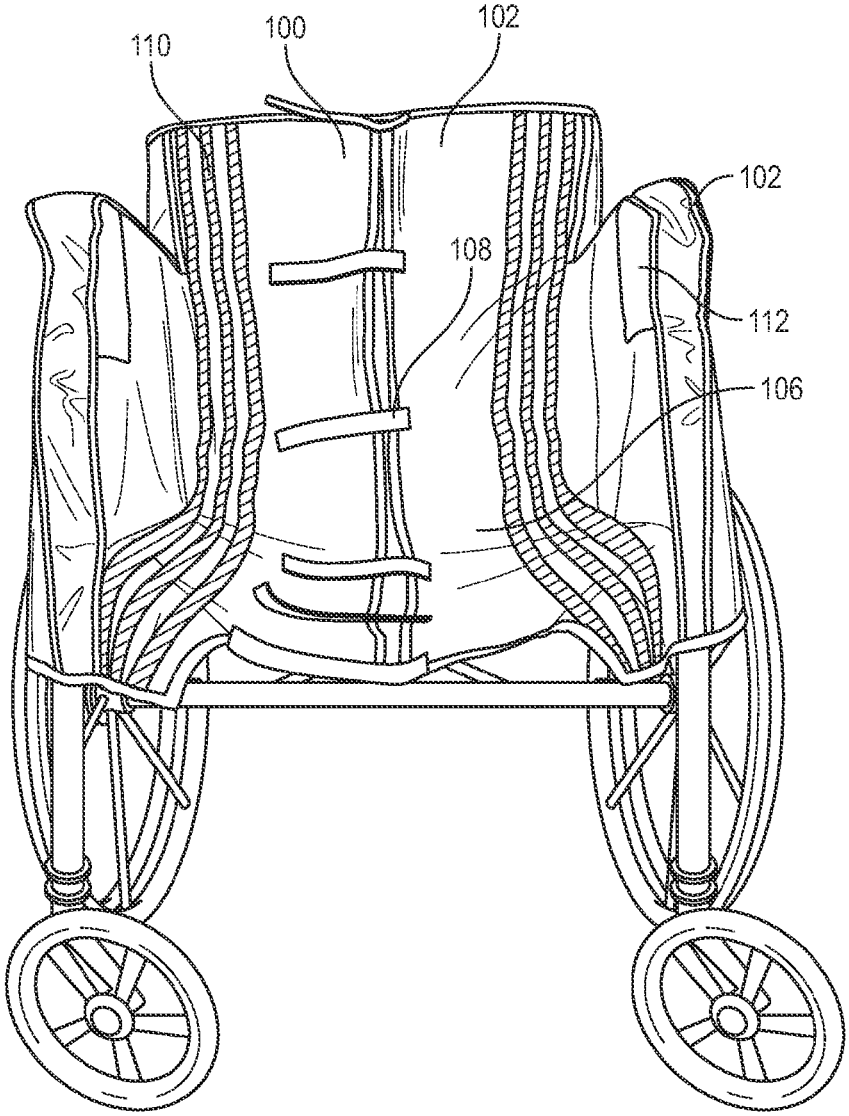
FIG. 2 is a front view of the first covering member of the wheelchair slipcover according to an exemplary embodiment of the present invention.

Referring now to the drawings, and particularly FIGS. 1 and 2, there is shown a perspective view and a front view of the first covering member 100 of a wheelchair slipcover having a back covering portion 102 covering a back of the wheelchair, armrest covering portions 104 extending around from each side of the back covering portion and attaching vertically along the seat portion 106 of the wheelchair. The back covering portion 102 covers around the back surface of the wheelchair and securely wraps around the posts of the back of the wheelchair. The back covering portion 102 further includes left and right front portions 103, 105 that cover the front surface of the backrest. The armrest covering portions 104 are received about the armrests, coupled to the left and right front portion 106 of the wheelchair. The left and right front portions include terminal ends 107, 109 in adjacent relationship, in an intermediate region of the front of the back of the wheelchair, extending the length thereof.

The armrest covering portions 104 include adjusters 112 that collapse and expand to fit standard arms and desk arms. Fasteners along the upper edges of the armrest can be adjusted and opened to fit the standard wheelchair arm length. For desk arms, which are indented at the end so that the wheelchair can move in closer to a desk or table, the armrest covering portions 104 are collapsed and closed. Furthermore, fasteners along the upper edges of the armrest can be adjusted in varying degrees for different customized arm rests. For smaller arm rests, the armrest covering portion is collapsed and closed. For larger arm rests, the armrest covering portion can be incrementally opened and expanded.

Attachments 109 couple the left and the right front panels 103, 105 together, across the front side of the back of the wheelchair. In the exemplary embodiment, the attachments are hook-and-loop fasteners. Other useful attachment means include, but are not limited to, Velcro straps, buttons, zippers, snap in clips, and the like. The attachments are adjustable to accommodate various widths of different sized wheelchairs and secure the slipcover tightly over the wheelchair to prevent the sides of the slipcover from coming in contact with the wheels and hand brake. Alternatively, there are predetermined locations where the panels can attach.

The first covering member 100 includes a plurality of fasteners 110(*a,b*) on the left and right front portions 103, 105 disposed adjacent to the armrests, extending the length of the front portions 103, 105. The fasteners extend from the top of the back rest to the front edge of the seat and attach to corresponding fasteners on back end of the second covering member. In the exemplary embodiment, the fasteners are spaced to accommodate different wheelchair sizes, e.g., narrow, standard, and wide. The outermost fasteners are positioned for use with relatively narrow wheelchairs, e.g., having a width of about 15 to 17 inches. The innermost fasteners are positioned for use with relatively wide wheelchairs, e.g., having a width of about 19 to 24 inches. The intermediate fasteners are positioned for use with regular size wheelchair, e.g., having a width of about 17 to 19 inches. In other embodiments, fasteners can be configured to accommodate various other sizes (e.g., 24 to 34 inches for extra wide) as well as fastening devices or approaches.

Figure 3:
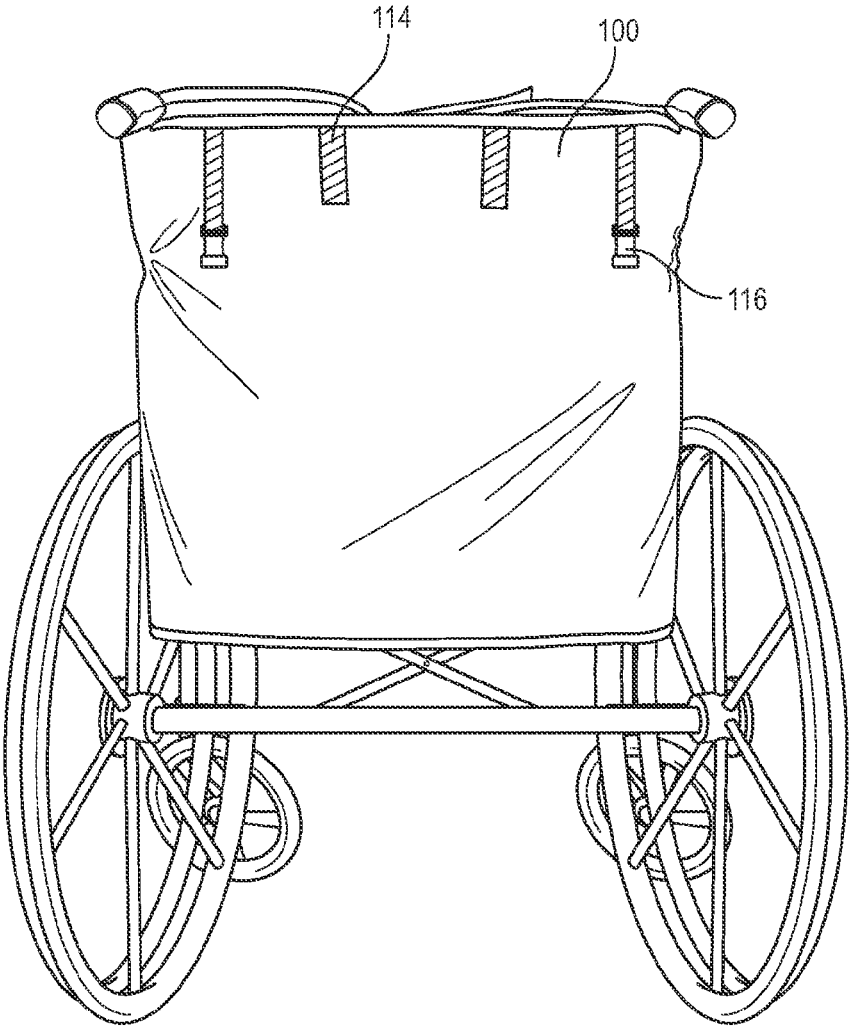
FIG. 3 is a back view of the first covering member of the wheelchair slipcover according to an exemplary embodiment of the present invention.
Figure 4:
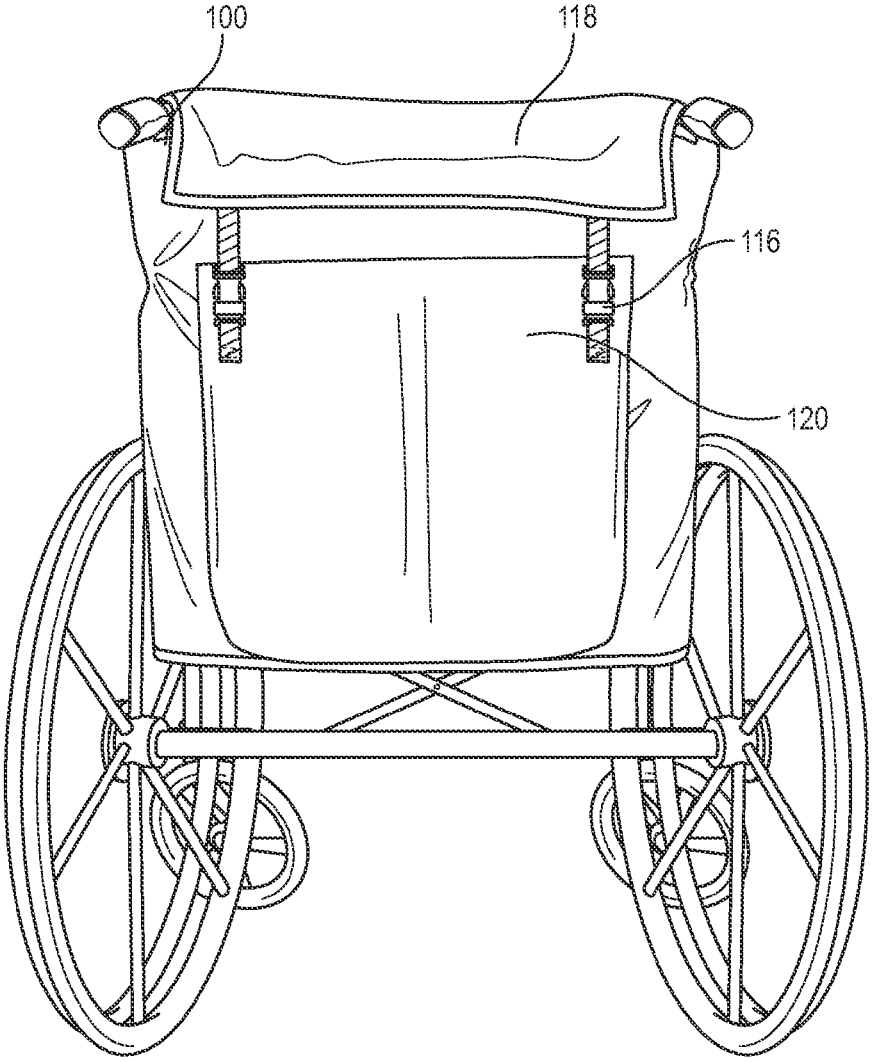
FIG. 4 is a back view of the first covering member of the wheelchair slipcover with an external pocket according to an exemplary embodiment of the present invention.

Referring now to FIGS. 3 and 4, there is shown a back view of the wheelchair slipcover. The first covering member 100 is received on the back over the surface of the back of a wheelchair. A plurality of attachments 114 is disposed along the top edge of the back portion to attach to a second covering member. In addition, a plurality of attachments 116 for a removable pocket or display is disposed on the back of the wheelchair. Specifically referring to FIG. 4, there is shown a second covering member 118 attached along the top edge of the back portion of the first covering member 100. In addition, there is shown a removable pocket 120 attached to the back portion of the first covering member 100.

Figure 5:
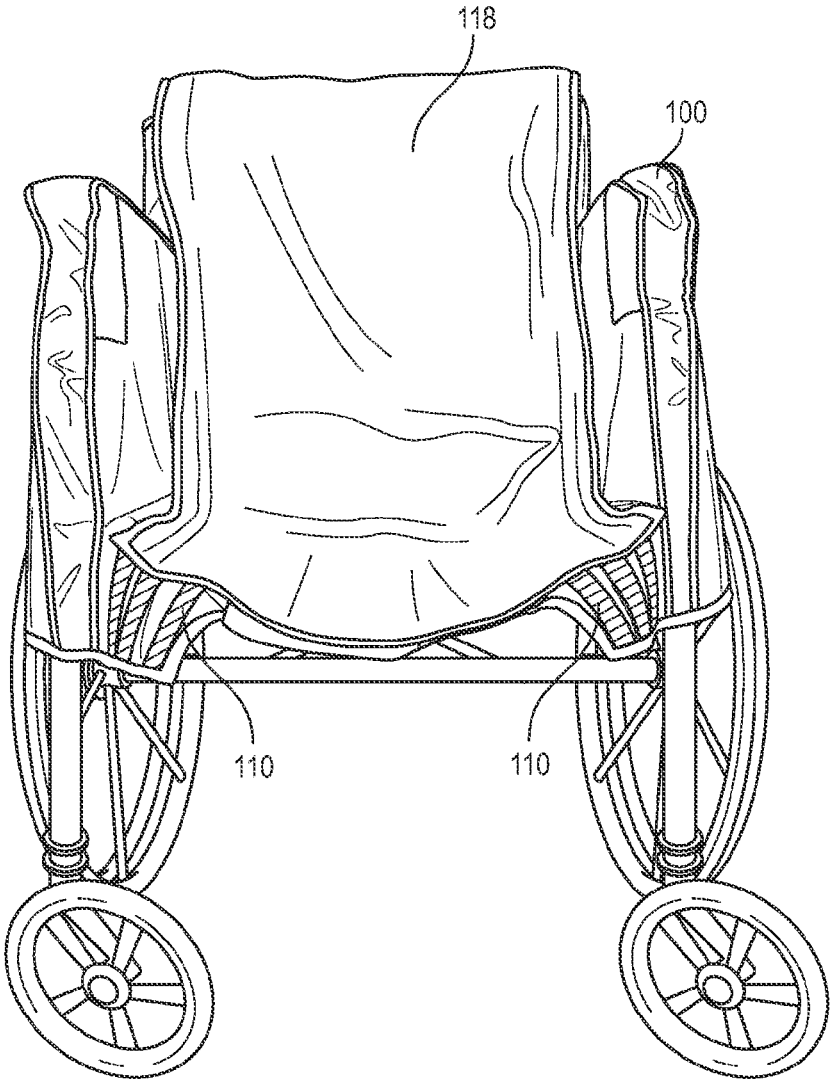
FIG. 5 is a front view of the wheelchair slipcover.
Figure 6:
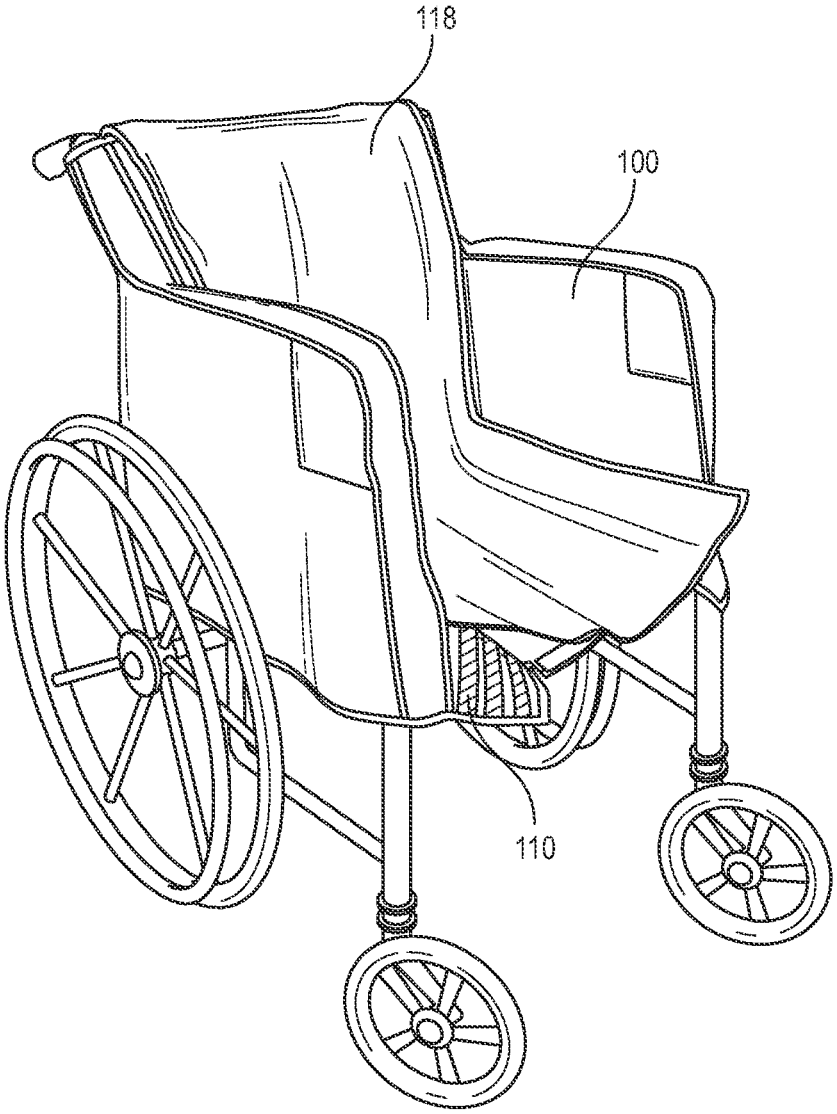
FIG. 6 is a front view of an exemplary embodiment of the wheelchair slipcover having a third covering member covering a cushion.

In reference to FIG. 5, there is shown a front view of a second covering member 118 removably attached on top of a first covering member 100. The second covering member 118 is received on the top of the backrest and is removably attached by vertical fastener strips extending from the top of the back rest to the front edge of the seat of the first covering member 100. In FIG. 6, there is shown a perspective view of a second covering member 118 removably attached to the top of a first covering member 100.

Figure 7:
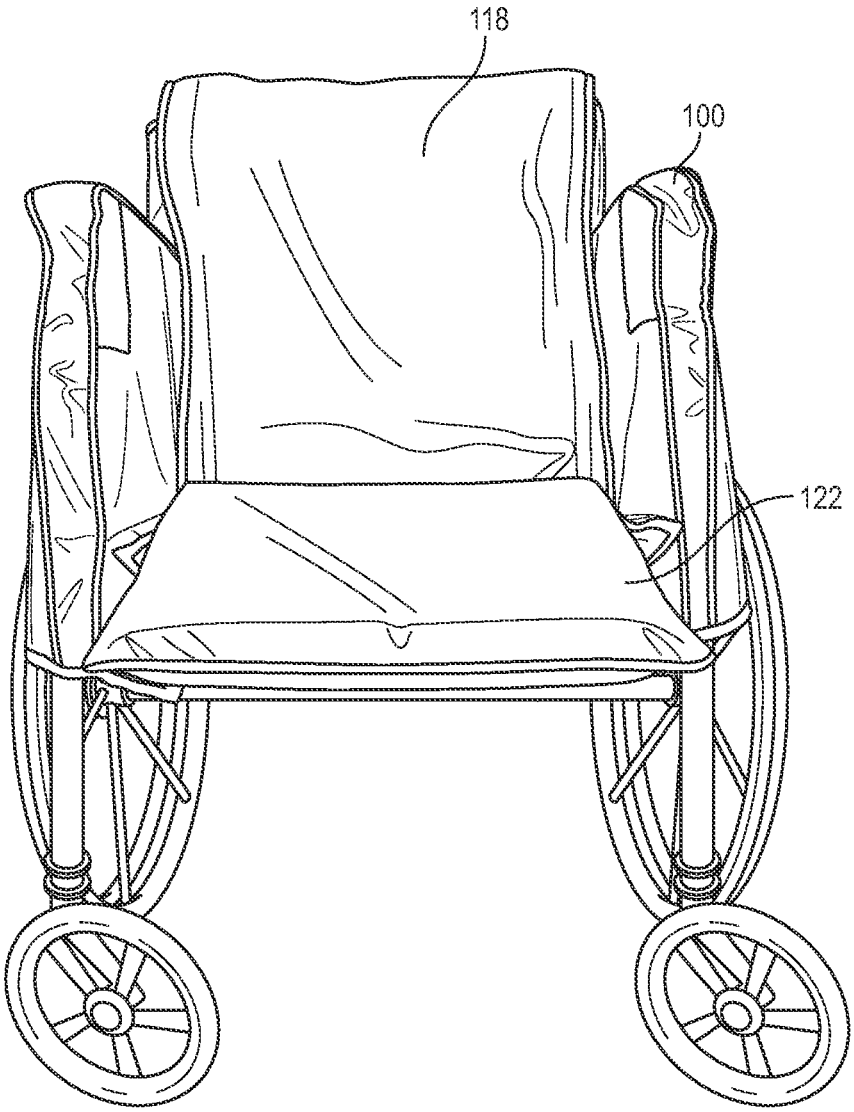
FIG. 7 is a perspective view of the wheelchair slipcover.

Referring now to FIG. 7, there is show a front view of an exemplary embodiment having a third covering member covering a cushion 122 disposed on the seat of the wheelchair. The cushion 120 can be removably attached to the inner armrest portion of the first covering member, the seat portion of the second covering member, or both. Alternatively, the cushion is secured in placed by wedging between the armrests.

Figure 8:
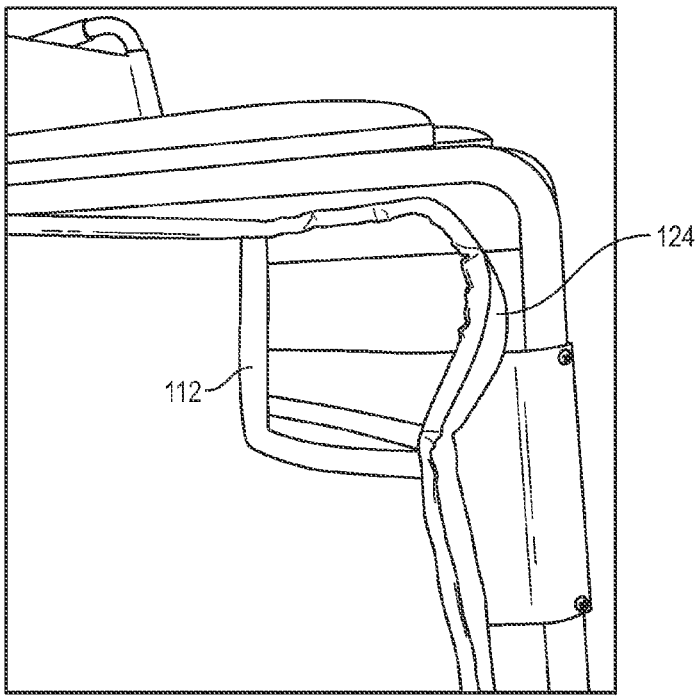
FIG. 8 is a side perspective side view of the adjustable armrest covering portion expanded next to a standard arm of a wheelchair.
Figure 9:
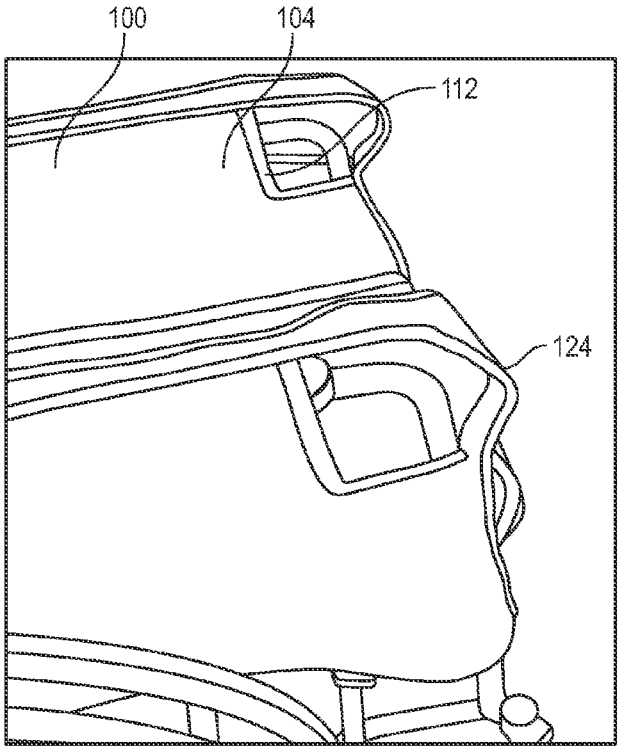
FIG. 9 is a side perspective view of the adjustable armrest-covering portion expanded to fit a standard arm of a wheelchair.

FIG. 8-11 shows the adjusters 112 of the armrest covering portion 104. FIG. 8-9 shows the armrest covering portions 104 expanded to fit a standard arm. The armrest covering portions 104 include adjusters 112 that collapse and expand the armrest covering portions to fit different types of arm rests such as a standard arm or a desk arm. In the exemplary embodiment, the adjusters 112 include hook-and-loop fasteners along the upper edges 124 of the armrest covering portion and along sidewall edges 126. In other embodiments, other attachment mechanisms can be used, for example, as shown in FIGS. 1-6, the adjusters include snaps 132.

Figure 10:
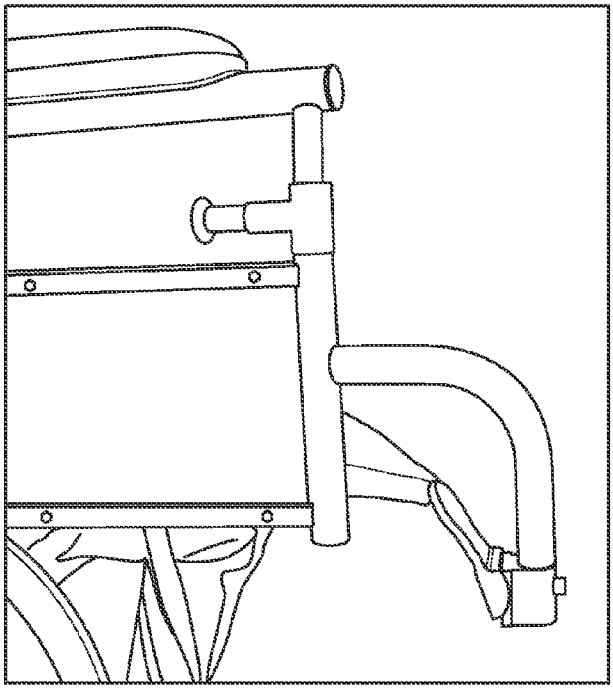
FIG. 10 is a side perspective view of a desk arm of a wheelchair.
Figure 11:
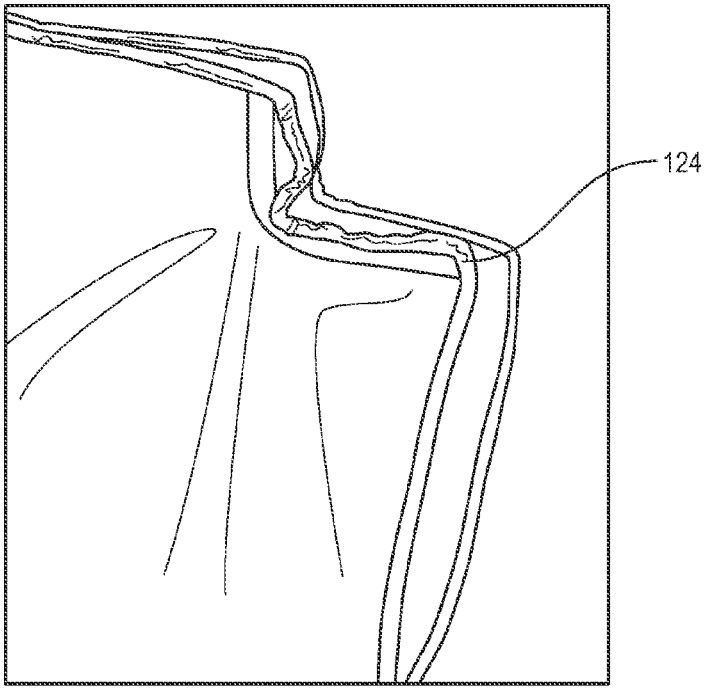
FIG. 11 is a side view of the adjustable armrest-covering portion collapsed to fit a desk arm of a wheelchair.

For larger arm rests, the armrest covering portion 104 can be incrementally opened and expanded. FIG. 9 shows a close up of an expanded armrest covering portion 104. For smaller arm rests, such as desk armrests, the armrest covering portions 104 are collapsed and closed, as shown in FIG. 10-11. More particularly the fasteners along the upper edges 124 attach to corresponding fasteners along sidewall edges 126 to reduce the armrest length along the top thereof to accommodate the desk armrest of the wheelchair. In this manner, the slipcover can be adapted to accommodate various lengths of armrests.

With reference again to FIG. 6, the wheelchair slipcover can include reflective nighttime piping 130 to enhance visibility at night or low visibility. Since wheelchairs are generally manufactured with seating material that is black or navy with a dark metal frame, a wheelchair is nearly invisible at night. Reflective nighttime piping will visibly outline the wheelchair shape and make it immediately recognizable and identifiable.

It should be appreciated from the foregoing that the present invention provides a wheelchair slipcover that is adjustable for different wheelchair sizes and configurations. In addition, the wheelchair slipcover addresses many of the shortfalls of a standard wheelchair and provides convenience, support, sanitary conditions, among others, for a wheelchair user. Moreover, the wheelchair slipcover provides the user the ability to personalize a slipcover for aesthetic purposes.

Although the invention has been disclosed in detail with reference only to the exemplary embodiments, those skilled in the art will appreciate that various other embodiments can be provided without departing from the scope of the invention. Accordingly, the invention is defined only by the claims set forth below.

What is claimed is:

1. A wheelchair slipcover, comprising:

a first covering member integrally formed to cover a back, a left armrest, and a right armrest of a wheelchair, the first covering member having, a back covering portion sized to cover a back surface of the back of a wheelchair, a left armrest covering portion extending from the back covering portion and sized to cover the left armrest, a right armrest covering portion extending from the back covering portion and sized to cover the right armrest, a left front portion extending from the left armrest covering portion configured to be disposed over a portion of a front surface of the back of the wheelchair and having a terminal edge, and a right front portion extending from the right armrest covering portion configured to be disposed over a portion of the front surface of the back of the wheelchair and having a terminal edge in adjacent relationship to the terminal edge of the left front portion; and a second covering member removably attached on the right front portion and the left front portion of the first covering member, wherein the left and the right armrest covering portions each include adjusters configured to collapse and expand the armrest covering portions to fit different lengths of armrests.

2. The wheelchair slipcover as defined in claim 1, wherein the adjusters include fasteners along upper edges of the armrest covering portions that mate with corresponding fasteners along sidewalls of the left and the right armrest covering portions.

3. A wheelchair slipcover, comprising:

a first covering member integrally formed to cover a back, a left armrest, and a right armrest of a wheelchair, the first covering member having, a back covering portion sized to cover a back surface of the back of a wheelchair, a left armrest covering portion extending from the back covering portion and sized to cover the left armrest, a right armrest covering portion extending from the back covering portion and sized to cover the right armrest, a left front portion extending from the left armrest covering portion configured to be disposed over a portion of a front surface of the back of the wheelchair and having a terminal edge, the left front portion having a plurality of fasteners in spaced relationship, and a right front portion extending from the right armrest covering portion configured to be disposed over a portion of the front surface of the back of the wheelchair and having a terminal edge in adjacent relationship to the terminal edge of the left front portion, the right front portion having a plurality of fasteners in spaced relationship; and a second covering member removably attached on the right front portion and the left front portion of the first covering member, the second covering portion having a flap removably attached to the back covering portion, the second covering member configured to attach to a subset of the plurality of fasteners of the left and the right front portions, to accommodate the width of the wheelchair.

4. The wheelchair slipcover as defined in claim 3, wherein a third covering member covering a cushion is placed on the seat of the wheelchair.

5. The wheelchair slipcover as defined in claim 4, wherein the cushion is removably attached to the inner armrest portion of the first covering member, the seat portion of the second covering member, or both.

6. The wheelchair slipcover as defined in claim 3, wherein the slipcover is lined with reflective nighttime piping.

7. The wheelchair slipcover as defined in claim 3, wherein the slipcover includes a plurality of removable pockets disposed on an inside of the arm rest, outside of the arm rest, or back of the wheelchair.

8. The wheelchair slipcover as defined in claim 3, wherein the plurality of fasteners are selected from a group consisting of hook-and-loop, snaps, buttons, and zippers.

9. The wheelchair slipcover as defined in claim 3, wherein the left and the right armrest covering portions each include adjusters configured to collapse and expand the armrest covering portions to fit different lengths of armrests.

10. The wheelchair slipcover as defined in claim 9, wherein the adjusters include fasteners along upper edges of the armrest covering portions that mate with corresponding fasteners along sidewalls of the left and the right armrest covering portions.

11. A wheelchair slipcover, comprising:

a first covering member integrally formed to cover a back, a left armrest, and a right armrest of a wheelchair, the first covering member having, a back covering portion sized to cover a back surface of the back of a wheelchair, a left armrest covering portion extending from the back covering portion and sized to cover the left armrest and having fasteners along upper edges thereof that mate with corresponding fasteners along sidewalls of the left armrest covering portion configured to collapse and expand to fit different lengths of armrests, a right armrest covering portion extending from the back covering portion and sized to cover the right armrest and having fasteners along upper edges thereof that mate with corresponding fasteners along sidewalls of the right armrest covering portion configured to collapse and expand to fit different lengths of armrests, a left front portion extending from the left armrest covering portion configured to be disposed over a portion of a front surface of the back of the wheelchair and having a terminal edge, the left front portion having a plurality of fasteners in spaced relationship, and a right front portion extending from the right armrest covering portion configured to be disposed over a portion of the front surface of the back of the wheelchair and having a terminal edge in adjacent relationship to the terminal edge of the left front portion, the right front portion having a plurality of fasteners in spaced relationship; and a second covering member removably attached on the right front portion and the left front portion of the first covering member, the second covering portion having a flap removably attached to the back covering portion, the second covering member configured to attach to a subset of the plurality of fasteners of the left and the right front portions, to accommodate the width of the wheelchair.

12. The wheelchair slipcover as defined in claim 11, wherein the plurality of fasteners on the left and right front portions are disposed adjacent to the corresponding armrests, extending the length of the respective front portions, the plurality of fasteners extend from a top of a back rest to a front edge of the seat.

13. The wheelchair slipcover as defined in claim 12, wherein the second covering member includes fasteners configured to attach to a subset of the plurality of fasteners of the left and the right front portions, to accommodate the width of the wheelchair to accommodate different wheelchair sizes.

14. The wheelchair slipcover as defined in claim 11, wherein the slipcover includes a plurality of removable pockets disposed on an inside of the arm rest, outside of the arm rest, or back of the wheelchair.

* * * * *